US005372663A

United States Patent [19]

Shibue et al.

[11] Patent Number: 5,372,663

[45] Date of Patent: Dec. 13, 1994

[54] POWDER PROCESSING OF TITANIUM ALUMINIDE HAVING SUPERIOR OXIDATION RESISTANCE

[75] Inventors: Kazuhisa Shibue; Mok-Soon Kim; Masaki Kumagai, all of Aichi, Japan

[73] Assignee: Sumitomo Light Metal Industries, Ltd., Tokyo, Japan

[21] Appl. No.: 821,154

[22] Filed: Jan. 3, 1992

[30] Foreign Application Priority Data

Jan. 17, 1991 [JP] Japan ..... 3-018453

[51] Int. Cl.[5] ..... C22C 14/00

[52] U.S. Cl. ..... 148/669; 75/249; 148/670; 419/49; 420/417

[58] Field of Search ..... 148/669, 670; 420/417; 75/249; 419/49

[56] References Cited

U.S. PATENT DOCUMENTS

| | | | |
|---|---|---|---|
| 3,496,036 | 2/1970 | DiGiambattista | 148/126 |
| 3,729,971 | 5/1973 | Gurganus | 72/226 |
| 4,849,168 | 7/1989 | Nishiyama et al. | 420/418 |
| 4,917,858 | 4/1990 | Eylon et al. | 419/18 |
| 4,936,927 | 6/1990 | Grunke et al. | 148/421 |
| 5,074,907 | 12/1991 | Amato et al. | 419/49 |

FOREIGN PATENT DOCUMENTS

| | | | |
|---|---|---|---|
| 0363598 | 4/1990 | European Pat. Off. | C22C 14/00 |
| 1255632 | 10/1989 | Japan | C22C 14/00 |
| 2200743 | 8/1990 | Japan | C22C 14/00 |
| 3219034 | 9/1991 | Japan | C22C 14/00 |
| 3257130 | 11/1991 | Japan | C22C 14/00 |

OTHER PUBLICATIONS

Eloff et al Prog. In Powder Metallurgy, vol. 37, 1982, p. 267.

Eylon et al Progress in Powder Met, vol. 42 (1986) pp. 625–634.

Eylon et al "Status of Ti-Powder Metallurgy" ASTM, 1984, pp. 48–65.

*Primary Examiner*—Upendra Roy

*Attorney, Agent, or Firm*—Flynn, Thiel, Boutell & Tanis

[57] ABSTRACT

Ti powders and Al powders are combined to prepare a mixture of 40~55 at % of Al and the balance of Ti. After CIP and degassing, plastic working by hot extrusion is applied to form a shaped mixture of Ti and Al. The shaped mixture is then processed by HIP to synthesize titanium aluminide while diffusing Al into the Ti structure to form an $Al_2O_3$ phase occurring from both the reaction between Al and oxygen contained in the Ti structure and the oxides on the Al surface, and to disperse the $Al_2O_3$ to form the $Al_2O_3$ protective film. With the reaction between Al and oxygen contained in the Ti structure and with the "Pegging" effect, both the $Al_2O_3$ a phase formed at the grain boundaries of crystals or in the crystal grains of titanium aluminide and the $Al_2O_3$ phase existing on the surface of raw material Al powder peg the surface $Al_2O_3$ film to the surface of the titanium aluminide body. This "Pegging" effect enhances the adhesiveness of the film and improves the oxidation resistance of titanium aluminide.

2 Claims, 1 Drawing Sheet

POWDER PROCESSING OF TITANIUM ALUMINIDE HAVING SUPERIOR OXIDATION RESISTANCE

FIELD OF THE INVENTION

This invention relates to a method of producing titanium aluminide having superior oxidation resistance.

More specifically, it relates to method of producing titanium aluminide with improved oxidation resistance by forming a strongly adhesive $Al_2O_3$ film on the titanium aluminide at service temperatures, which is suitable for heat resistant components used in the fields of automobile, aircraft, space, and industrial equipment manufacture.

BACKGROUND OF THE INVENTION

Titanium aluminide (intermetallic compound of the Ti—Al series) are expected to be useful materials for internal-combustion engine components such as inlet and outlet valves and piston pins because they are light weight materials having superior rigidity and high temperature strength.

For practical applications to such heat resistant components, the material should have high oxidation resistance as well as high temperature strength. Titanium aluminides alone, however, do not have sufficient resistance to oxidation, so attempts have been made to improve the oxidation resistance by adding alloying elements.

For example, JP-A-1-246330 (the term "JP-A-" referred to herein signifies "unexamined Japanese patent publication") reports that the addition of 0.3~5.0% of Si to Ti-30~45 wt % Al improves the oxidation resistance. JP-A-1-259139 presents a Ti—Al intermetallic compound having superior high temperature oxidation resistance, containing 22~35 wt % of Al and 5~20 wt % of Cr, and it also notes that further improvement of high temperature oxidation resistance is achieved by adding 0.01~3 wt % of Y, 0.01~3 wt % of Re, 0.01~0.2 wt % of C, 0.01~1 wt % of Si, and 0.01~0.2 wt % of B. JP-B-1-50933 (the term "JP-B-" referred to herein signifies "examined Japanese patent publication") states that the addition of 100~1000 at PPM of P to a Ti—Al intermetallic compound composed of 40~50 at % of Ti and 60~50 at % of Al improves the oxidation resistance.

Nevertheless, the addition of these alloying elements does not necessarily result in a sufficient improvement of oxidation resistance, and furthermore, when a specific property is intended to be boosted, other superior characteristics often suffer bad effects.

SUMMARY OF THE INVENTION

It is the main object of this invention to provide a method of producing titanium aluminide having a superior oxidation resistance.

It is another object of this invention to provide a method of producing titanium aluminide having an improved oxidation resistance by forming a strongly adhesive $Al_2O_3$ film thereon without adding alloying elements. It is a further object of this invention to provide a method of producing titanium aluminide having increased adhesiveness of $Al_2O_3$ through the use of a Pegging effect.

These objects are achieved by the sequential processing of Ti powder and Al powder or Al alloy powder, wherein these powders are combined and formed into shaped mixtures of Ti and Al or Al alloy using a plastic working method followed by a heat treatment in an inert atmosphere at a temperature of 300° C. or above to synthesize titanium aluminide while diffusing Al into the Ti structure and to form and disperse the $Al_2O_3$ phase occurring in both the reaction between Al and oxygen in the Ti structure and the oxides on the Al powder surface.

Ti powder and Al powder, both raw materials of titanium aluminide, are mixed at a composition of 40~55 at % of Al. Less than 40 at % of Al addition results in an excessive amount of $Ti_3Al$ in the product, which does not provide sufficient oxidation resistance. More than 55 at % of Al addition significantly degrades ductility which is also an important characteristic.

Mn is known as an element which improves the ductility of titanium aluminide (JP-B-62-215), but is also recognized to degrade oxidation resistance. The oxidation resistance mechanism of this invention is, however, effective to a composition containing one or more of the elements selected from the group of Mn, V, Cr, Mo, Nb, Si, and B. Therefore, this invention does not reject the addition of these metallic components to Ti powder and Al powder, the raw materials of titanium aluminide.

Elements of Mn, V, Cr, Mo, and Nb act as components to improve the ductility at room temperature. The preferred adding range of these elements is from 0.5 to 5 at %. Addition of less than 0.5 at % results in a rather weak effect on improving ductility, while more than 5 at % saturates the effect. Si acts as a component to further improve oxidation resistance. The preferred adding range of Si is from 0.1 to 3 at %. Less than 0.1 at % of Si results in a rather weak effect on improving ductility, while more than 3 at % degrades ductility at room temperature. B improves strength at a preferred adding range of 0.01 to 5 at %. Less than 0.01 at % of B results in a rather weak effect on improving ductility, while more than 5 at % degrades ductility at room temperature.

A plastic working method is employed to form shaped mixtures of Ti and Al from the mixed raw material powders. Extrusion, forging, or rolling can be applied as the processing means of the plastic working method.

These techniques can be combined with pre-treatments such as powders compaction or vacuum degassing of the powder mixture. The prepared shaped mixture is then subjected to heat treatment in a vacuum or inert gas atmosphere, such as Ar, at 300° C. or higher, preferably at 500° C. or higher, up to a practical upper limit of 1,460° C., for a period ranging from 0.5 to 500 hours, followed by compression processing. The heat treatment and compressing are preferably carried out with a HIP (Hot Isostatic Press) unit to obtain dense titanium aluminide. Furthermore, in order to obtain a uniform and dense titanium aluminide, the preferred HIP treatment conditions are a temperature range of 1,200° to 1,400° C. and a processing period of 0.5 to 100 hours.

When a shaped mixture of Ti and Al is heated to 300° C. or higher, Al diffuses into the Ti structure. The diffusion becomes active at 500° C. or higher temperatures and is self-promoted accompanied by an exothermic reaction to form titanium aluminide. During the heat treatment process, the $Al_2O_3$ phase is formed in the titanium aluminide and is dispersed therein. The $Al_2O_3$ phase is generated by both the reaction between Al diffused in the Ti structure and oxygen unavoidably existing in the Ti structure as well as the oxides on the Al powder surface.

The oxidation resistance of titanium aluminide is obtained by the formation of a protective film with strong adhesiveness on the surface thereof. Thus, the formation of a dense $Al_2O_3$ film by selective oxidation of Al is preferred.

Generally, however, an $Al_2O_3$ film formed during the initial stage of titanium aluminide oxidation does not necessarily have sufficient adhesiveness, so the film peels in the succeeding oxidation stage, which promotes a rapid oxidation denaturation of titanium aluminide as well as the formation of $TiO_2$.

Regarding the improvement of adhesiveness of the protective film, the application of a "Pegging" mechanism is known to be effective.

This mechanism improves the adhesiveness through an anchoring effect by pegging the surface protective film to the metallic body using oxide pegs, which grow into the metallic structure. [B. Lustman: Trans. Metall. Soc. AIME, 188 (1950), 995]

According to this invention, the $Al_2O_3$ phase, which is formed or dispersed at the grain boundaries of crystals or at the phase boundaries or in the crystal grains of titanium aluminide and which is generated by both the reaction between Al diffused in the Ti structure and oxygen unavoidably existing in the Ti as well as the oxides on the surface of the Al powder, one of the raw materials, contributes to the formation of "pegs". These "pegs" act to enhance the interfacial adhesiveness by pegging the $Al_2O_3$ film formed by the initial oxidation in the heating stage up against the metallic body.

In concrete terms, when Ti powder and Al powder are mixed at a composition of 40~50 at % of Al and the balance of Ti followed by plastic working to form a shaped mixture which is then heat treated in an inert atmosphere, Al elements diffuse into the Ti structure, and $Al_2O_3$ is formed at the grain boundaries of crystals, at the phase boundaries, or in the crystal grains by the reaction between oxygen in the Ti and the Al element.

Ti powder, one of the raw materials, usually contains oxygen, and the quantity thereof is sufficient to form "pegs" of $Al_2O_3$.

Nevertheless, it is preferable to adjust the quantity of oxygen in the Ti powder in a range of 0.005 to 1 at %.

Oxides are inevitably formed on the Al powder surface and these oxides can be used as "Pegs" as well.

Diffusion of Al elements begins at 300° C. or higher. In the heating stage at 500° C. or higher, the rapid exothermic reaction between Ti and Al activates the diffusion phenomenon to enhance $Al_2O_3$ formation.

The $Al_2O_3$ formed during this stage also functions as "pegs".

FIG. 1 is an illustration of the protective film which is formed by the method of this invention. In the illustration, the pegs 3 grow from the oxide film 2 on the $Al_2O_3$ phase formed on the surface of titanium aluminide 1 into the grain boundaries of crystals and the phase boundaries. This pegging effect enhances the interfacial adhesiveness.

The above described adhesion mechanism is typical of the method wherein Al elements diffuse into the Ti structure and wherein titanium aluminide is synthesized through the reaction between Ti and Al, which comprises this invention.

The formation of $Al_2O_3$ which can act as "pegs" in any titanium aluminide obtained from a melting and casting process is difficult and improved oxidation resistance cannot be expected.

DETAILED DESCRIPTION OF THE PREFERRED EMBODIMENT

This invention is described by referring to examples and comparative examples. This invention is not limited, however, to these examples.

EXAMPLE 1

Ti powder containing 0.2 at % of oxygen was mixed with Al-4 at % Mn alloy powder to prepare a mixture of Ti-48 at % Al-2 at % Mn. The mixture was shaped through CIP (Cold Isostatic Press) followed by degassing at 450° C. under $1.3\times10^{-4}$ Pa for 5 hours.

The obtained degassed shape was sealed in a vacuum aluminum can, which was then extruded at 400° C. to be cut into the predetermined size. The cut shaped mixture was subjected to a HIP process in an Ar gas atmosphere under conditions of 1,300° C., 152 GPa of pressure, and 2 hours of retention time to reactively synthesize titanium aluminide.

The obtained titanium aluminide was measured to determine the presence of oxygen segregation into the grain boundaries of crystals, the weight gain resulting from oxidation, and the tensile breaking elongation. Auger analysis was applied to determine the oxygen segregation into grain boundaries of crystals, where the titanium aluminide was shock-broken within the analytical unit and the broken surface was subjected to Auger analysis. As for the determination of weight gain caused by oxidation, a sample sized $10\times10\times20$ mm was cut from titanium aluminide and placed into a high purity alumina crucible, which was exposed to the ambient room atmosphere at 960° C. for 2 hours, followed by weighing. Table 1 shows the result of measurements.

Figure 1:
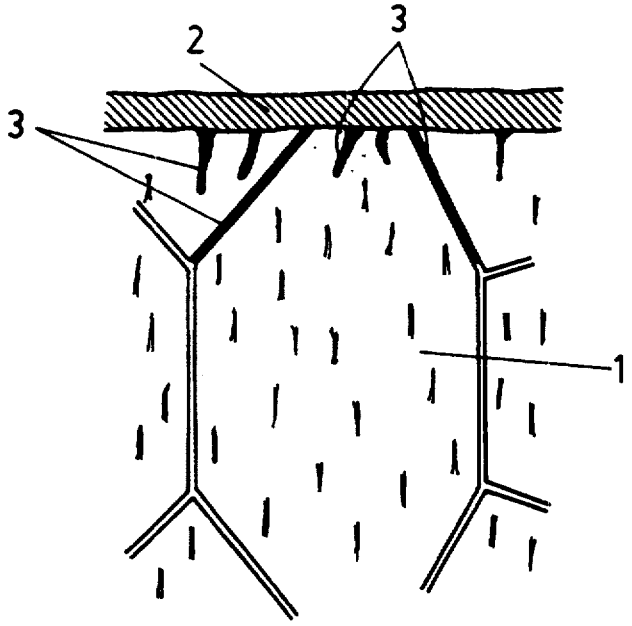
FIG. 1 shows the $Al_2O_3$ protective film formed by the method of this invention.
Figure 2:
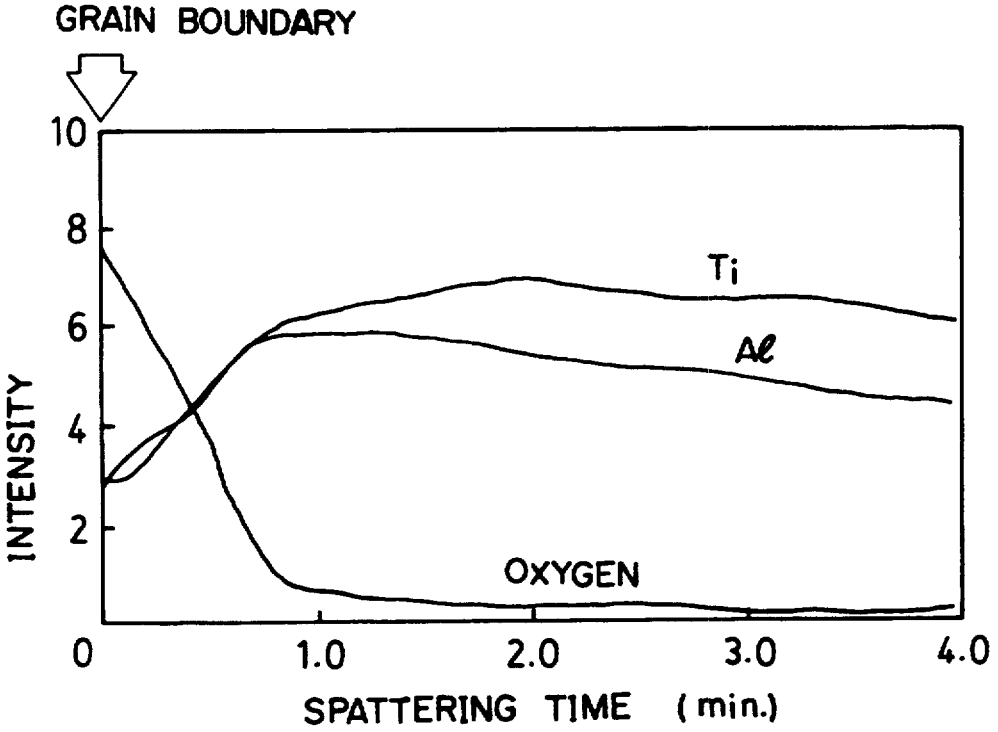
FIG. 2 is an Auger analysis graph showing the concentration profiles of Ti, Al, and oxygen in a range from the grain boundaries of crystals into the crystal grains.

FIG. 2 shows the concentration profiles of Ti, Al, and oxygen in a range from grain boundaries of crystals into crystal grains determined by Auger analysis.

FIG. 2 clearly demonstrates oxygen segregation to grain boundaries of crystals, which corresponds to the formation of an $Al_2O_3$ phase at the grain boundaries.

EXAMPLE 2

Ti powder containing 0.15 at % of oxygen was mixed with Al powder to prepare a mixture of Ti-43 at % Al, and titanium aluminide was produced therefrom using the same procedure employed in Example 1. Characteristics of the obtained titanium aluminide were determined with the same methods as in Example 1. The results are listed in Table 1.

EXAMPLE 3

Ti powder containing 0.1 at % of oxygen was mixed with Al powder to prepare a mixture of Ti-45 at % Al, and titanium aluminide was produced therefrom using the same procedure employed in Example 1. Characteristics of the obtained titanium aluminide were determined with the same methods as in Example 1. The results are listed in Table 1.

EXAMPLE 4

Ti powder containing 0.04 at % of oxygen was mixed with Al-3.5 at % Cr alloy powder to prepare a mixture of Ti-42.8 at % Al-1.2 at % Cr, and titanium aluminide was produced therefrom using the same procedure employed in Example 1. Characteristics of the obtained titanium aluminide were determined with the same methods as in Example 1. The results are listed in Table 1.

EXAMPLE 5

Ti powder containing 0.17 at % of oxygen was mixed with Al-3.4 at % V-0.1 at % B alloy powder to prepare a mixture of Ti-42.8 at % Al-1.16 at % V-0.03 at % B, and titanium aluminide was produced therefrom using the same procedure employed in Example 1. Characteristics of the obtained titanium aluminide were determined with the same methods as in Example 1. The results are listed in Table 1.

EXAMPLE 6

Ti powder containing 0.05 at % of oxygen was mixed with Al-3.0 at % Mo-0.5 at % Si alloy powder to prepare a mixture of Ti-42.8 at % Al-1.02 at % Mo-0.17 at % Si, and titanium aluminide was produced therefrom using the same procedure employed in Example 1. Characteristics of the obtained titanium aluminide were determined with the same methods as in Example 1. The results are listed in Table 1.

EXAMPLE 7

Ti powder containing 0.08 at % of oxygen was mixed with Al-3.0 at % Nb alloy to prepare a mixture of Ti-42.8 at % Al-1.02 at % Nb, and titanium aluminide was produced therefrom using the same procedure employed in Example 1. Characteristics of the obtained titanium aluminide were determined with the same methods as in Example 1. The results are listed in Table 1.

COMPARATIVE EXAMPLE 1

One hundred grams of titanium aluminide obtained in Example 1 were melted in a plasma-arc melting furnace. To prevent segregation, the ingot was repeatedly melted for a total of three times from the top surface and from bottom surface alternately, and a button-shaped ingot was produced. Characteristics of the obtained cast were determined with the same methods employed in Example 1. The results are listed in Table 1.

COMPARATIVE EXAMPLE 2

Ti metal containing 0.15 at % of oxygen was blended with Al metal, and the mixture was then melted in a plasma-arc melting furnace to obtain a ingot following the same procedure employed in Comparison example 1. Characteristics of the obtained titanium aluminide were determined with the same methods as in Example 1. The results are listed in Table 1.

COMPARATIVE EXAMPLE 3

The raw material powders used in Example 2 were combined to prepare a mixture of Ti-33 at % Al, and a titanium aluminide was obtained therefrom under the same synthetic condition as in Example 2. Characteristics of the obtained titanium aluminide were determined with the same methods as in Example 1. The results are listed in Table 1.

COMPARATIVE EXAMPLE 4

The raw material powders used in Example 3 were combined to prepare a mixture of Ti-58 at % Al, and a titanium aluminide was obtained therefrom under the same synthetic condition as in Example 3. Characteristics of the obtained titanium aluminide were determined with the same methods as in Example 1. The results are listed in Table 1.

TABLE 1

| Embodiment | Oxygen segregation into grain boundaries (positive/negative) | Weight gain from oxidation ($g/m^2$) | Tensile breaking elongation (%) |
|---|---|---|---|
| Example 120 | Positive | 7.5 | 1.3 |
| Example 2 | Positive | 3.2 | 1.2 |
| Example 3 | Positive | 5.7 | 1.4 |
| Example 4 | Positive | 6.3 | 1.1 |
| Example 5 | Positive | 6.0 | 0.9 |
| Example 6 | Positive | 2.5 | 0.9 |
| Example 7 | Positive | 3.2 | 1.1 |
| Comparative example 1 | Negative | 285 | 1.5 |
| Comparative example 2 | Negative | 165 | 1.0 |
| Comparative example 3 | Negative | 90 | 1.0 |
| Comparative example 4 | Positive | 2.5 | 0.1 |

As clearly shown in Table 1, the titanium aluminides given in Example 1 through 7, which were produced by the method of this invention, offer oxygen segregation into grain boundaries of crystals, very slight weight gain from oxidation, and relatively good elongation at tensile breaking. In contrast, the titanium aluminides in Comparison examples 1 and 2, which were produced by melting-casting process, exhibit a large weight gain due to oxidation, indicating that they have no oxidation resistance. In the product of Comparative example 3, which has less than 40 at % of Al, oxygen segregation into grain boundaries of crystals is observed but the weight gain from oxidation is extremely high, suggesting that no oxidation resistance is present.

On the other hand, in the product of Comparison example 4, which has more than 55 at % of Al, oxygen segregation into grain boundaries of crystals is observed and the weight gain from oxidation is also low, but the product suffers from reduced ductility.

As described above, the production method of this invention provides a titanium aluminide which always has high oxidation resistance without degrading ductility by applying an exclusive mechanism of $Al_2O_3$ phase formation and of oxide film adhesion. Thus, the method of this invention is highly useful for the production of heat resistant components of internal combustion engines, etc.

We claim:

1. A method of producing titanium aluminide having superior oxidation resistance, a weight gain from oxidation of less than 7.5 $g/m^2$ and an elongation at tensile breaking greater than 0.9% comprising the steps of:

mixing titanium powder containing from 0.005 to 1.0 at. % oxygen with aluminum powder to form a mixture of 40–55 at. % aluminum and the balance being oxygen-containing titanium powder;

plastic working said mixture to form a shaped mixture; and hot isostatic pressing said shaped mixture in an inert gas atmosphere or a vacuum at a temperature of from 1200° to 1400° C. and for a time of from 0.5 to 100 hours to form titanium aluminide having an alumina phase formed thereon and dispersed into the titanium.

2. A method of producing titanium aluminide having superior oxidation resistance, a weight gain from oxidation of less than 7.5 $g/m^2$ and an elongation at tensile breaking greater than 0.9% comprising the steps of:

mixing titanium powder containing from 0.005 to 1.0 at. % oxygen with aluminum powder and at least one member selected from the group consisting of 0.5 to 5 at. % of Mn, V, Cr, Mo or Nb, 0.1 to 3 at. % of Si and 0.01 to 5 at. % of B to form a mixture of 40 to 55 at. % aluminum, said at least one member and the balance being oxygen-containing titanium powder;

plastic working said mixture to form a shaped mixture; and hot isostatic pressing said shaped mixture in an inert gas atmosphere or a vacuum at a temperature of from 1200° to 1400° C. and for a time of from 0.5 to 100 hours to form titanium aluminide having an alumina phase formed thereon and dispersed into the titanium.

* * * * *